US006498909B1

(12) United States Patent
Reihl

(10) Patent No.: US 6,498,909 B1
(45) Date of Patent: Dec. 24, 2002

(54) METHOD AND APPARATUS FOR CONTROLLING THE TONER CONCENTRATION IN AN ELECTROGRAPHIC PROCESS

(75) Inventor: Heiner Reihl, Freising (DE)

(73) Assignee: Oce Printing Systems GmbH, Poing (DE)

( * ) Notice: Subject to any disclaimer, the term of this patent is extended or adjusted under 35 U.S.C. 154(b) by 0 days.

(21) Appl. No.: 09/869,750

(22) PCT Filed: Dec. 29, 1999

(86) PCT No.: PCT/EP99/10465

§ 371 (c)(1),
(2), (4) Date: Sep. 24, 2001

(87) PCT Pub. No.: WO00/41038

PCT Pub. Date: Jul. 13, 2000

(30) Foreign Application Priority Data

Jan. 5, 1999 (DE) ..... 199 00 164

(51) Int. Cl.[7] ..... G03G 15/00; G03G 15/06; G03G 15/16

(52) U.S. Cl. ..... 399/49; 399/66; 399/297; 399/384

(58) Field of Search ..... 399/49, 72, 58, 399/60, 61, 297, 317, 384, 66

(56) References Cited

U.S. PATENT DOCUMENTS

| | | | | |
|---|---|---|---|---|
| 4,468,112 A | | 8/1984 | Suzuki et al. | 399/29 |
| 5,122,835 A | | 6/1992 | Rushing et al. | 399/49 |
| 5,387,965 A | | 2/1995 | Hasegawa et al. | 399/60 |
| 6,115,561 A | * | 9/2000 | Fukushima | 399/49 |
| 6,249,656 B1 | * | 6/2001 | Watanabe et al. | 399/49 X |

FOREIGN PATENT DOCUMENTS

| | | |
|---|---|---|
| DE | 31 40 158 A1 | 4/1982 |
| DE | 196 31 261 A1 | 2/1997 |
| DE | 197 49 651 A1 | 6/1999 |
| EP | 0 403 523 B1 | 11/1992 |
| EP | 0 740 221 A1 | 10/1996 |
| EP | 0 837 372 A2 | 4/1998 |
| WO | WO 96/03782 | 2/1996 |
| WO | WO 97/17635 | 5/1997 |

OTHER PUBLICATIONS

Patent Abstracts of Japan—062 897 16 Oct. 18, 1994.
Patent Abstracts of Japan—10274891 Oct. 13, 1998.

* cited by examiner

*Primary Examiner*—Sophia S. Chen
(74) *Attorney, Agent, or Firm*—Schiff Hardin & Waite

(57) ABSTRACT

In a method and apparatus for adjusting an electrographic printing or copying process, information to be printed is generated as a toner intermediate image on a support for intermediate images and is subsequently transmitted from a reprinting surface to a recording medium at a transfer printing zone. A toner mark is produced on an electrographic support for intermediate images. The toner mark is at least partially scanned on the support for intermediate images and is then removed from the support for intermediate images. The toner Ad concentration is adjusted in a developing station by means of a measured value based on scanning the toner mark. Transfer of the toner intermediate image from the reprinting surface to the recording medium at the transfer printing zone is at least temporarily prevented in the period between the production and the removal of the toner mark.

19 Claims, 5 Drawing Sheets

METHOD AND APPARATUS FOR CONTROLLING THE TONER CONCENTRATION IN AN ELECTROGRAPHIC PROCESS

BACKGROUND OF THE INVENTION

The invention is directed to a method and to an apparatus for controlling an electrographic printing or copying process. The invention is particularly directed to a method and to a system for controlling the toner concentration in a toner/developer mixture.

EP 403 523 B1 discloses an electrographic process wherein a number of process parameters are monitored and regulated, including the toner concentration in a development station. It is provided for this purpose that a toner mark be generated on a photoconductor drum, that the mark be sensed on the photoconductor drum with a reflex light sensor, and the measured value be employed for the control of the toner resupply in the development station. The solid toner mark is thereby generated at the lateral edge of the photoconductor drum, so that it lies only in the region of the margin perforations with respect to the web-shaped, margin-perforated recording medium and thus does not lie in the actual writing region of the recording medium or of the photoconductor drum. A number of disadvantages result therefrom.

First, the toner mark can thus be only designed relatively small, as a result of which the sensing area and, thus, the measuring precision as well are limited, particularly transversely relative to the transport direction of the photoconductor drum or of the recording medium. Second, it is definitely meaningful for regulating various parameters of the electrographic process to also apply and sense a toner mark in the actual writing region of the photoconductor drum. Particularly when employing web-shaped recording media, for example what is referred to as continuous stock, however, spoilage then arises because the recording medium printed in this way is no longer available for being printed with other information. Conditioned by the process, third, edge effects, for example of the electrical field, arise at the edges of a photoconductor, as a result of which the expressiveness of a measurement in this region is diminished. Such edge effects superimpose all the more greatly the narrower a toner mark is.

WO 97/17635 A discloses an electrophotographic printer device that contains compensation elements, particularly rockers, springs and other prestressing elements, that are intended to avoid fluctuations in the position of the recording medium in the region of the transfer printing zone. This is particularly necessary in a duplex mode wherein the web-shaped recording medium is conducted twice through the same transfer printing station. However, nothing noteworthy can be derived from this publication with respect to the regulation of the electrographic process.

DE 198 01 521.6 (applicant's reference 980101DE) discloses a control method for the toner/developer mixture, what is referred to as a two-component development system, in an electrographic printer or copier device. in this method, a toner mark is sensed at least two places with respect to the transport direction of the photoconductor drum. In order to achieve an adequate sensing precision with this method, it is necessary that the toner mark be adequately broad. It would thereby be especially advantageous if the toner mark could also extend into the actual writing region of the photoconductor drum.

DE 197 49 651.2 (applicant's reference 971104DE) discloses an electrophotographic printer that can process both recording media with margin perforation as well as recording media without margin perforation. A unit with a friction drive is provided for this purpose and can be pivoted against and away from a photoconductor drum so precisely that the recording medium again comes to lie exactly at the original position with respect to the photoconductor drum after being pivoted away and back in. The components disclosed therein are designed therefor that the pivoting in and away occurs, for example, during the course of a service call. Such a printer, on the other hand, is suited for printing a recording medium without a margin perforation wider than a recording medium with a margin perforation. A recording medium free of margin perforations can then also be printed by the photoconductor drum in the region of the drum wherein the margin perforations are located given a margin-perforated recording medium. This advantage, however, is accompanied by the disadvantage that the toner mark must be transfer-printed onto the unperforated, web-shaped recording medium in its writing region and, thus, spoilage again arises.

U.S. Pat. No. 5,387,965 A and U.S. Pat. No. 4,468,112 A disclose electrographic processes wherein the toner concentration in a development station is identified and compared to a rated value. The rated value is dependent on a second measurement event in which a toner mark is interpreted.

SUMMARY OF THE INVENTION

An object of the invention is to specify a method and an electrographic system wherein a monitoring of toner density can occur and wherein an optimally high printing width on the recording medium can be achieved at the same time.

This object is achieved by a method and system of the invention for regulating an electrographic printing or copying process wherein information to be printed are generated as an intermediate toner image on an intermediate image carrier and are later transferred from a transfer printing surface onto a recording medium in a transfer printing zone. A toner mark is generated on an intermediate image carrier such as an electrographic intermediate image carrier. The toner mark on the intermediate image carrier is sensed at least in regions and the toner mark is subsequently in turn removed from the intermediate image carrier. The toner concentration in a development station is regulated with a measured value such as a density value. The transfer of the intermediate toner image from the transfer printing surface onto the recording medium is at least temporarily prevented in the time span between the generation and the removal of the toner mark.

According to a first aspect of the invention, the information to be printed are generated as an intermediate toner image on an intermediate image carrier with a photoconductor drum and, in a transfer printing zone, are transferred later from a transfer printing surface, for example from the surface of the photoconductor drum or from a transfer printing tape, onto a recording medium. For regulating the toner density, a toner mark is generated on the electrographic intermediate image carrier, the toner mark on the intermediate image carrier is sensed at least in regions, and the toner mark is in turn removed from the intermediate image carrier later. In particular, the density is sensed at the toner mark. The toner concentration is then regulated with the measured value, particularly density value, in a development station such that the inking can be kept constant. A transfer of the intermediate toner image from the transfer printing surface onto the recording medium is at least temporarily prevented in the time span between the generation of the toner mark on the intermediate image carrier and the removal of the toner mark from the intermediate image carrier. This impeding transfer of the transfer printing is particularly prevented during a time span wherein the toner mark passes the transfer printing zone. The prevention of the transfer printing can, in particular, occur by separation/lift-off of the recording medium from the transfer printing surface.

In particular, the invention provides two operating states for the operation of an electrographic printer or copier device. In the first operating state, what is referred to as the measurement cycle, a toner mark is generated on the intermediate image carrier, the density of the toner mark is sensed, and the toner mark is then in turn removed from the intermediate image carrier. The sensed toner density value is employed for the regulation of the toner concentration in the development station and, in particular, has influence on a toner concentration rated value and/or on a control threshold. In the second operating state, information to be printed are generated on the intermediate image carrier as a toner image and are transfer-printed onto the recording medium later. In the second operating state, the toner concentration is, in particular, controlled with the toner concentration or regulation threshold determined from the first operating state.

Inventively, the recording medium is at least temporarily separated or lifted off from the transfer printing surface, particularly from the intermediate image carrier, in the first operating state. The invention is therefore suited for generating the toner mark on the intermediate image carrier in a region in which the information to be printed onto the recording medium are also output. The recording medium is, in particular, web-shaped and can, for example, be made of paper.

A photoconductor drum is particularly provided as an intermediate carrier on which the toner mark is generated. The recording medium is separated or lifted off from it for at least one revolution. In a further embodiment of the invention, a photoconductor tape is employed as a first intermediate image carrier and/or a transfer band is employed as a second intermediate image carrier. Information to be printed are thereby generated on the first intermediate image carrier, are subsequently transferred onto the transfer band and are finally transfer-printed from the transfer band onto the recording medium.

In particular, density values of several toner marks can be employed for determining the rated value in the regulation of the toner concentration. The various toner marks can derive from a plurality of measurement cycles that lie far apart in time or can be formed in a continuous measurement cycle, particularly with one or with several revolutions of the photoconductor drum.

A rapidly switchable, high-precision mechanical lift-off device can, in particular, be employed for separating the recording medium from the transfer printing surface. It is thereby particularly provided that the recording medium lies in nearly the same position with respect to the transfer printing station both in the conveying direction as well as transversely relative to the conveying direction before the lift-off and after being pivoted back in. Optionally, the recording medium can be moved or the transfer printing surface or the transfer printing element can be moved for separating the recording medium from the transfer printing surface. Instead of or in addition to the mechanical movement, an electrophotographic quantity in the region of the transfer printing station is modified in a further version for preventing the transfer printing such that a transfer printing is suppressed. For example, the electrical voltage at a transfer printing corotron can be reduced for this purpose.

As a result of the invention, two operating states of the device are created that are employed alternating in time. The operating state wherein the toner mark is generated and interpreted and no transfer printing onto the recording medium occurs is thereby temporally inserted between the other operating state wherein print information are transfer-printed onto the recording medium.

What is especially advantageous about the invention is that the toner mark can be designed very broad, up to the entire width of the intermediate image carrier, for example of a photoconductor drum. As a result thereof, the toner mark can be interpreted at a plurality of locations, particularly according to the method disclosed by DE 198 01 521.6. The content of this application and the WO Publication corresponding with this application is herewith incorporated into the present specification.

The toner mark can also be positioned at any arbitrary location within the printing width of the intermediate image carrier. As a result of these possibilities, not only is the measurement precision enhanced compared to narrow toner marks but the possibility is also created to apply various methods for the interpretation of the toner mark instead of an evaluation of the toner density. For example, an interpretation of the shape of the generated toner mark or the comparison thereof to a rated shape is also possible. This further enables the interpretation methods to be optimized for colored toner. Various interpretation methods can be combined to form an overall interpretation, for example various interpretation methods and/or color-specific properties of the toner mark sensor can be taken into consideration color-specifically with respect to the toner color.

The evaluation method of the toner mark can be designed due to the adaptability of the toner mark in view of its position, size and shape such that independence from the toner color can be achieved. This also particularly applies when an optoelectronic toner mark sensor works in a narrow light wavelength spectrum, for example in only one color, and its light has a direct influence on the reflection and absorption behavior of the toner-pigments. In this case, in particular, the shape recognition of a large-area mark can be advantageously utilized.

In a second aspect of the invention, toner marks in an electrographic process are cyclically generated and sensed only at relatively large page intervals, for example only after a few thousand printed pages. In the intervening printing intervals, the tone concentration is then implemented in some other way, for example based only on other measured quantities. One such other measured quantity can, for example, be the toner concentration, this being measured in the development station with a toner concentration sensor. A rated value, for example for the toner concentration or for a regulation threshold, is then defined from the measured value (toner density, toner mark shape, etc.) determined from the toner mark and the toner concentration is regulated therewith. This regulation of the toner concentration in a development station to be applied between the toner mark measurements can occur in a known way.

Corresponding to the second aspect of the invention, the toner replenishment is regulated in some other way over relatively large printing intervals (between the tone mark evaluation cycles). Instead of or in addition to the toner concentration control that has just been described, the toner consumption can also be identified on the basis of the printed information, particularly as a result of the total number of printed picture elements (pixels). This determination can also occur dependent on the contrast ratio set at the printer device, on a specific transfer printing efficiency, on the age of the toner/developer mixture, on the toner type and/or on other influencing variables. The delivery of toner into the development station from a toner reservoir can then be controlled with quantities defined in this way.

The second aspect of the invention achieves the object of being able to implement a largely independent regulation of the toner inking in an electrographic process in the intervals between the formation and measurement of the toner mark.

Exemplary embodiments of the invention are explained in greater detail below on the basis of some Figures. Further advantages and effects of the invention become clear therefrom.

DESCRIPTION OF THE PREFERRED EMBODIMENTS

Figure 1:
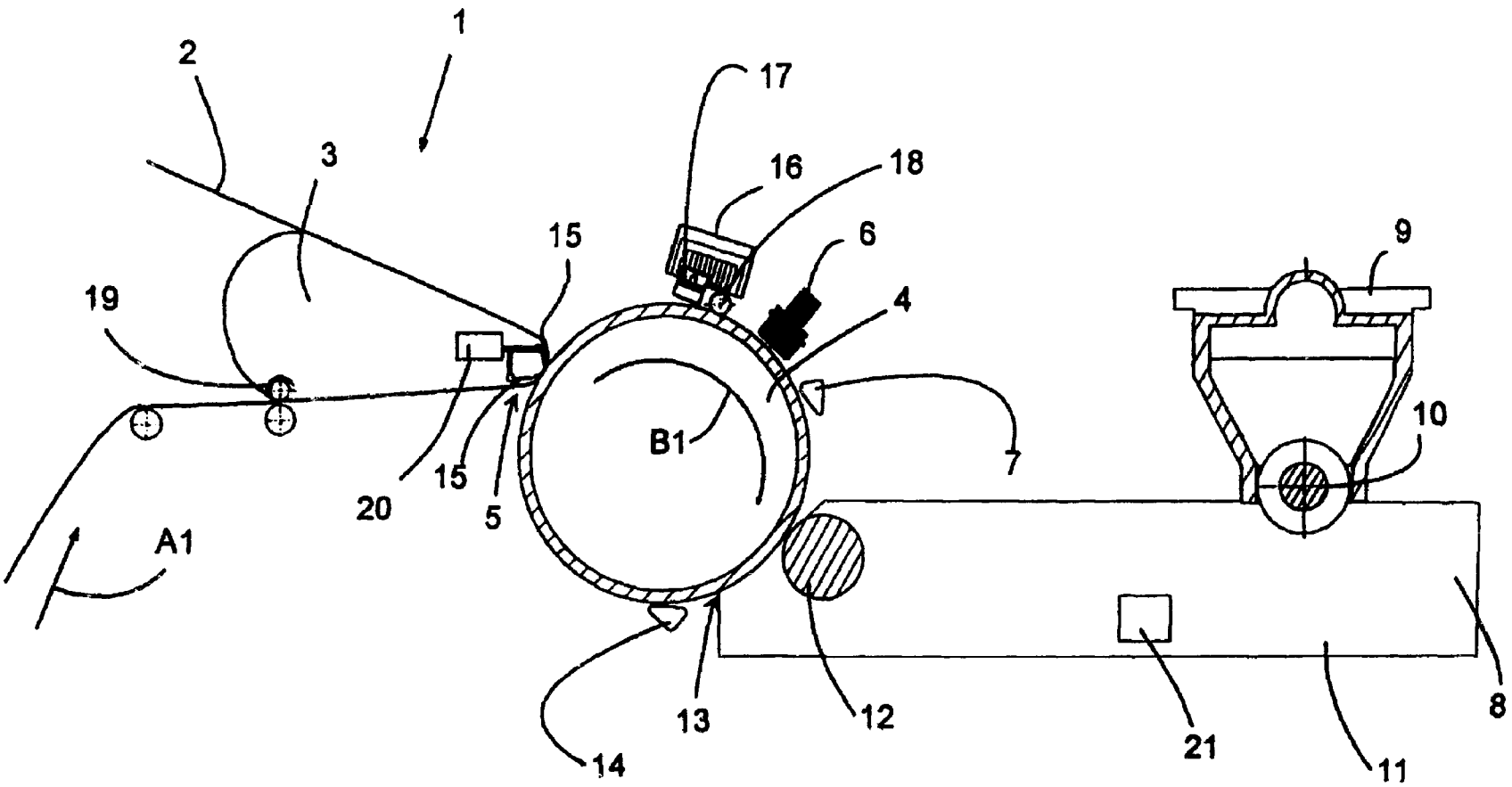
FIG. 1 is a schematic sectional view of an electrophotographic printer device.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alternations and further modifications in the illustrated device, and such further applications of the principles of the invention as illustrated therein being contemplated as would normally occur to one skilled in the art to which the invention relates.

FIG. 1 schematically shows a printer device 1 for web-shaped recording media working according to the principle of electrophotography. The web-shaped recording medium in the form of a paper web 2 is supplied to a photoconductor drum 4 by a drive unit 3 having a motor-driven friction drum 19. Details of the drive unit 3 and other components can be derived from DE 197 49 651.2, the content thereof or of the corresponding patent in the USA being herewith incorporated by reference into the present specification. Additionally, the unit contains movable swivel elements 15 with which the paper web 2 can be pressed against the surface of the photoconductor drum or lifted off therefrom. For that purpose, they can be automatically moved by an electrical actuator 20, for example a stepping motor or lifting magnet. Details about suitable swivel elements in the form of transfer printing rockers are known, for example, from WO 97/17635 A1. In particular, they can be designed like the rockers 40 and 44 shown in FIG. 5 of the WO publication and can be pivotably seated at shafts such that the paper web can be swivelled in and out in length-neutral fashion with respect to parts of the drive unit lying farther away. The content of WO 97/17635 A1 is herewith likewise incorporated by reference into the present specification.

Returning to FIG. 1, the paper web 2 is printed in a transfer printing zone 5. For that purpose, the photoconductor drum 4 driven via a motor is charged with an intermediate toner image by various connected units, the intermediate toner image being transfer-printed onto the paper web 2 in the transfer printing zone 5. A first unit is a character generator 6 that contains a comb of light-emitting diodes with individually derivable light-emitting elements that, for example, can be constructed according to WO 96/3782 A1. This publication is herewith incorporated by reference into the present specification. The light intensity of the character generator 6 can be regulated by variation of the drive voltage or drive current. An electronic control drives the individual light-emitting diodes according to the image information to be printed. The illumination station is followed by a charge sensor 7 that measures the surface potential on the photoconductor drum 4 and outputs a signal dependent thereon. The image (charge image) generated on the photoconductor drum 4 with the character generator 6 in character-dependent fashion is inked with the assistance of a development station 8. The development station 8 contains a toner reservoir 9 for the acceptance of toner as well as a metering device 10 in the form of a metering drum. The metering drum 10 delivers toner to a mixing chamber 11 dependent on the toner consumption. A toner/developer mixture of ferromagnetic carrier particles and toner particles is located in the mixing chamber 11. The toner mixture is supplied to a development drum 12. The development drum 12 acts as what is referred to as a magnetic brush drum and comprises of a hollow drum with the magnetic ledges arranged therein. The development drum 12 transports the developer mixture to a development gap between the photoconductor drum 4 and the development drum 12. Excess developer mixture is transported back into the mixing chamber via the development drum 12. The development station 11 is followed by a toner mark sensor 14 with respect to the rotational sense $B_1$ of the photoconductor drum 4. The toner mark sensor 14 is an optoelectronic sensor that, for example, can be designed as a reflected light barrier. It is composed of a light source and of a phototransistor as a receiver. The output signal of the phototransistor is dependent on the reflectivity of the information applied on the photoconductor drum 4 and inked via the development station. In particular, the sensor senses a toner mark that serves for the determination of the color saturation, i.e. of the applied optical density of the toner mark. The wavelength of the reflection light barrier is selected such that the scan light has no influence on the function of the photoconductor drum 4.

The toner mark is started when a test routine is called or is regularly automatically started, for example after 2000 printed pages. The toner mark that is generated then is sensed, and the test pattern is evaluated, for example in view of inking density and/or color saturation.

During the running of the test routine or the generation of the toner mark, the paper web 2 is pivoted away from the photoconductor drum, so that it does not touch the surface 4*a* of the photoconductor drum 4 in the transfer printing zone 5. The drive unit 3 or the pressure elements pressing the paper web 2 against the photoconductor drum 4 are then pivoted away from the photoconductor drum 4.

A cleaning device 16 with which residual toner is removed from the photoconductor drum 4 that was not released from the photoconductor drum 4 or transfer-printed onto the paper 2 in the region of the transfer printing zone, and is situated following the transfer printing zone 5 as viewed in the rotational sense of the photoconductor drum 4. The cleaning station 16 is built in the usual way and contains, for example, a stripper element 17 that strips the excess toner or the carrier particles from the photoconductor drum 4. The cleaning process is supported by a corona device 18. Moreover, further corona devices are provided in the printer device in a known way. These include, for example, a charging corotron that is provided between the cleaning device 16 and the character generator 6. Illumination devices that serve the purpose of discharging the photoconductor drum 4 can also be arranged in the apparatus. Further details about the electrophotographic process and the devices required therefor are disclosed, for example, by EP 403 523 B1, the content thereof as well as the content of the corresponding patent in the USA being herewith incorporated by reference into the present specification.

Figure 2:
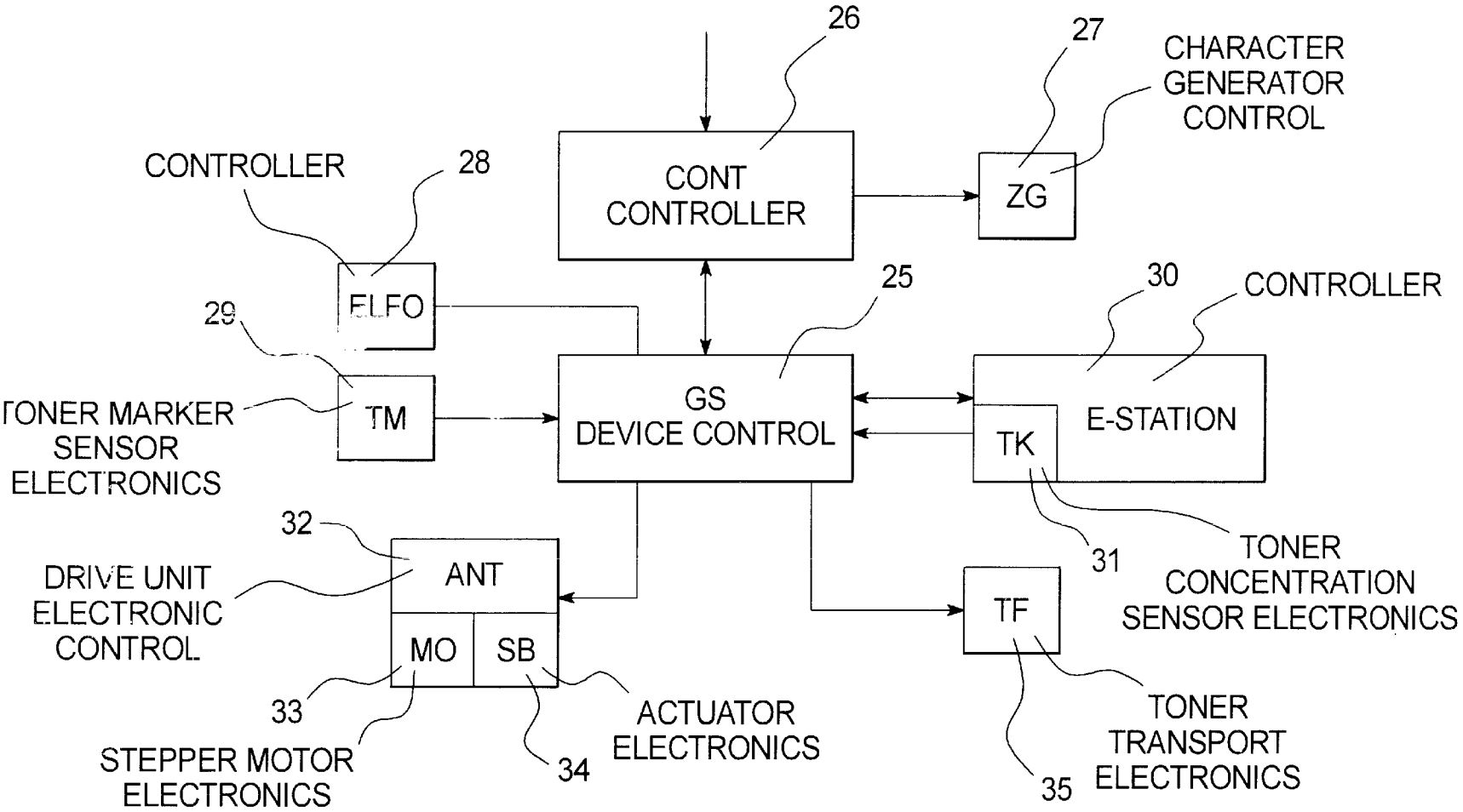
FIG. 2 illustrates electronic components of the printer device.

FIG. 2 shows a device control 25 of the electrographic printer that is connected to all electronic components of the various units of the device, so that the executive sequences can be coordinated with one another. The device control 25 is connected, on the one hand, to a controller 26 to which print data to be printed are input and where converts into signals to drive point-by-point the light-emitting diodes of the character generator 6. These signals are transmitted to the control 27 of the character generator. Further, the device control 25 is connected to a controller 28 that controls electrophotographic parameters such as the voltages of corotron wires.

The toner mark sensor 14 that senses the photoconductor drum 4 comprises toner mark sensor electronics 29 that are likewise in communication with the device control 25. The controller 30 of the development station 8 bilaterally exchanges data with the device control 25. The toner concentration sensor 21, which measures the concentration of the toner in the toner/developer mixture in the mixing chamber 11 of the development station 21, comprises toner concentration sensor electronics 31 that is likewise connected to the device control 25.

Finally, the device control 25 is also connected to the electronic control 32 of the drive unit 3. The control 32, in particular, drives stepper motor electronics 33 of the stepping motor that moves the paper web 2 and also controls the electronic components that activates the stepping motor 20 or a corresponding lifting magnet for the pressure elements 15. Of course, the various pressure elements 15 can also be equipped with their respectively own stepping motors or lifting magnets in order to thus be able to accomplish an individual pressing of the rockers. Further, the device control 25 is connected to toner transport electronics 35 that effects the toner transport from an external toner reservoir into the development station. A further electronics can be provided within the development station to control the metering of the toner from the toner reservoir 9 into the mixing chamber 11 with the metering drum 10.

The executive sequence of the printing and of the toner concentration regulation shall now be described in greater detail on the basis of FIG. 3. Method steps S1 through S5 show a first operating state wherein print data are transfer-printed onto the paper web 2. A check is carried out in step S1 to see whether print data are present. When this is not the case, the printer device switches into a standby condition in which various units like the photoconductor drum, transfer printing corotron, the transport unit, etc., are set to a low energy consumption.

As soon as the device control 25 receives a signal from the controller 26 that print data are present, this activates the participating units, the electrophotographically relevant units in step S3 and the transport unit 3 in step S4. In particular, the actuator motor 20 with which the paper web 2 is swivelled against the surface of the photoconductor drum 4 is thereby activated. Further, the drive motor which drives the friction transport roller 19 for the transport of the paper web is activated. Subsequently, the print data to be output are written via the character generator 6 onto the photoconductor drum 4 as an intermediate toner image, the intermediate toner image on the photoconductor drum being applied onto the photoconductor drum 4 in the development gap 13 of the development station 8 and is transfer-printed onto the paper web 2 in the transfer printing zone. Later, the toner image that has been transfer-printed in this way is fixed on the recording medium 2 in a fixing device. During the normal printing phase (steps S1 through S5), the toner concentration in the development station 8 is monitored by a toner concentration control. The toner concentration in the development station 8 is thereby permanently acquired with the sensor 21, and a constant toner/developer mixture is maintained in the mixing chamber 11 by means of an appropriate replenishment with the conveyor device 10.

Alternatively to the regulation of the toner concentration with the toner concentration sensor 21, it is also possible to control the toner quantity conveyed per time unit by the device 10 in that the transfer-printed, set picture elements (pixels) are counted in the controller 26 and/or other quantities are employed defining the toner consumption such as, for example, the contrast setting of the image, the temperature of the photoconductor drum or the like for defining the amount of toner conveyed.

In step S6, a check is carried out to see whether the end of the print job has been reached. When this is the case, then the printing procedure is ended. When not, then a check is carried out in step S7 to see whether a page counter that counts successively with every printed page from an initial counter reading $N_0$=2000 is equal to zero. When not, then the page counter is lowered by a value in step S8 and the transfer printing of the next page can occur (step S5).

When the page counter is N=0, the printer operations are ended in step S11 and the second operating mode is started for generating a toner mark. At the same time, the page counter is reset in step S10 to the initial value $N_0$=2000.

After respectively 2000 pages, thus the normal printing process is interrupted and a check of the current development conditions is implemented on the basis of a toner mark. For that purpose, the paper web 2 is first pivoted away from the surface of the photoconductor drum 4 in the transfer printing zone 5 with the pressure elements 15. The paper transport is thereby also arrested.

In step S9, the value of the page counter is deposited in a memory of the printer control 25.

The steps S12 through S17 describe a second operating state wherein a toner mark is written onto the photoconductor 4 and interpreted for the modification of the toner conveying control, which occurs during the transfer printing phase (S5) in the normal printing operation.

In step S12, one or more toner marks are successively written onto the photoconductor drum 4. The toner marks can be generated during a revolution of the photoconductor drum or, alternatively, a plurality of toner marks can be generated over a plurality of revolutions of the photoconductor drum 4. The toner marks are so wide that they proceed into the writing region of the photoconductor drum wherein print information are output in the normal printing operation (step S5), these being normally transfer-printed onto the paper web 2. As needed, the toner mark can even extend over the entire width of the photoconductor drum 4.

Such marks are generated on the photoconductor drum 4 or the marks are sensed with the sensor 14 in step S13 and interpreted in the control 25. The interpretation can occur in view of the generated toner density and/or on view of the shape of the toner mark. Dependent on the type of toner employed (for example, different colors), the toner mark or, respectively, the toner marks can exhibit different densities, shapes and/or dimensions. A value is then derived from the values, this value being compared to a regulation threshold RS in step S14. When the toner density value OD of the toner marks lies in the interval [RS−Δ, . . . , RS+Δ], then the operating mode of the toner mark printing can be aborted in step S17 and a switch can be made back to the normal print operation mode.

When, in contrast, the toner density OD lies outside the interval [RS−, . . . , RS+], then a toner transport is initiated in step S15 and a further toner mark is generated according to step S12. This process (steps S12 through S15) is repeated until the inking OD of the toner mark lies in the required interval. Finally, at least one correction value is determined from the operating mode of toner mark generation in step S16, the regulation of the toner concentration in the normal printing phase (steps S5 through S8) being adapted therewith. In particular, a control threshold for the toner concentration is thereby modified.

The regulation of the toner concentration in the printing intervals that lie between the balanced operating states wherein toner marks are formed and interpreted can, for example, occur according to the methods disclosed by U.S. Pat. No. 4,468,112 A or U.S. Pat. No. 5,387,965 A. Their contents are herewith incorporated into the present specification by reference. In the balance operating states, a difference is thereby formed from the measured toner density and the rated value of the toner density, and the difference value is employed for the determination of a new rated toner concentration value or of a threshold for the toner concentration regulation.

In a somewhat modified toner concentration regulation, a factor for modifying a rated toner concentration value and/or a toner concentration control threshold is employed from the measured value.

In a somewhat simplified version of the adaptation of the toner concentration regulation wherein no toner concentration sensor is required (but it can nonetheless be helpful), the quantity of toner conveyed into the development station per time unit can also be adapted in step S12. Other quantities such as the sum of a set of, for example black pixels, the temperature of the photoconductor drum, or the image contrast that has been set can be additionally taken into consideration in the regulation of the toner transport during the normal printing process.

Figure 4:
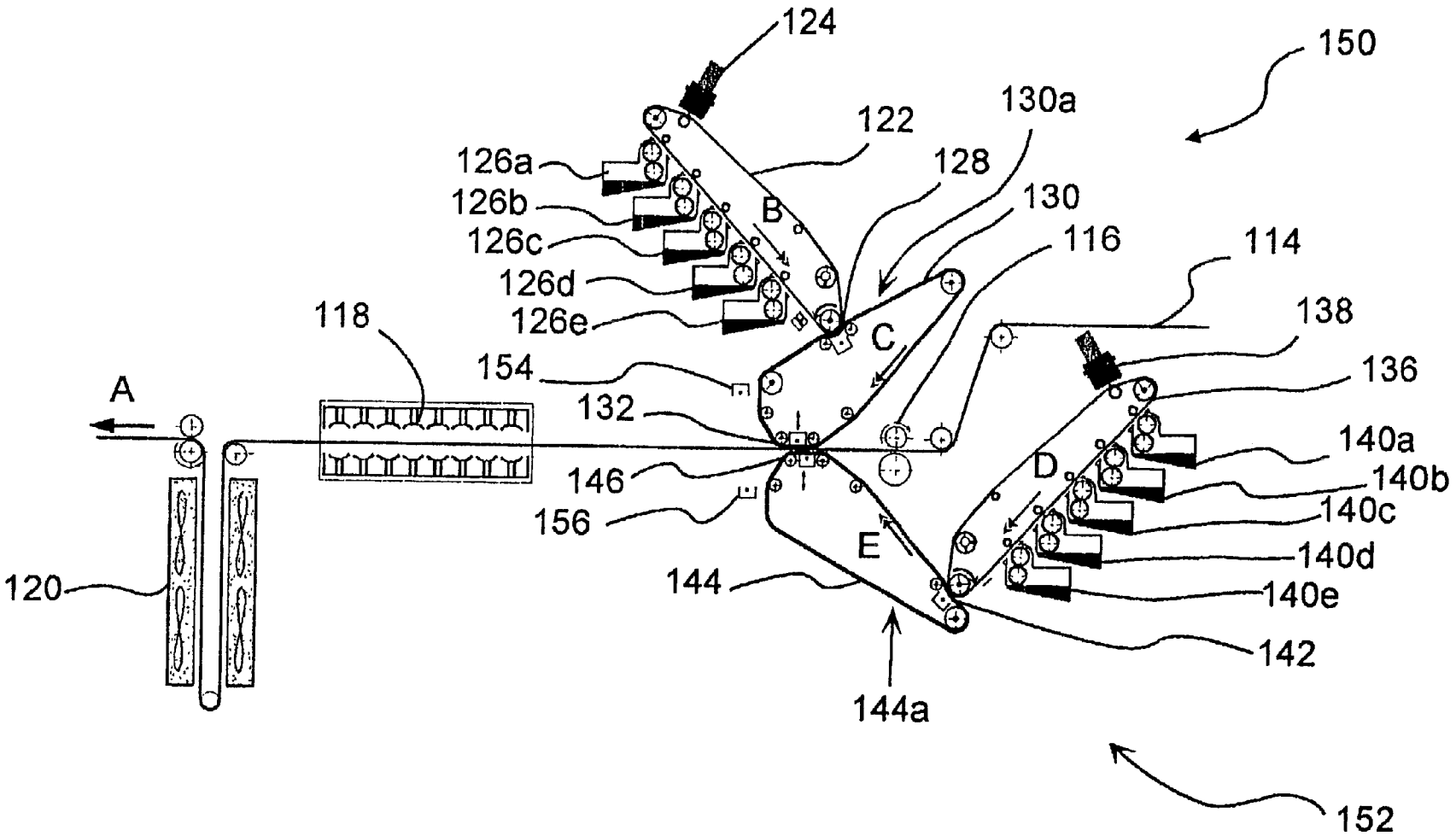
FIG. 4 is a second electrographic printer device.

FIG. 4 shows a further printer device wherein at least one latent image is generated on a photoconductor band 122 by a first character generator 124 in a first printing unit 150. One or more intermediate toner images are generated on the photoconductor band 122 in motion direction B using a plurality of development stations 126*a*, 126*b*, . . . 126*e* that contain toner having different colors.

Correspondingly, a second character generator 138 and a plurality of development stations 140*a* through 140*e* in a second printing unit 152 generate latent images and intermediate toner images in various colors in motion direction D on a second photoconductor band 136. This printer device is disclosed in greater detail in German Patent Application DE 198 561 45.8 of the assignee (internal reference 981101DE). The content of this German Patent Application or of the corresponding patent in the USA is herewith likewise incorporated by reference into the present specification.

At a first transfer printing location 128, the intermediate toner images are transferred from the first photoconductor band 122 onto a first transfer band 130 running in direction C and, at a third transfer printing location 142, are transferred from the second photoconductor band 136 onto a second transfer band 144 that moves in direction E. The transfer band 130, 144 respectively collect the intermediate toner images of the various color separations and then transfer-print the full-color image onto both sides of the web-shaped recording medium 114, i.e. duplex, at a second transfer printing station 132 or, respectively, a fourth transfer printing station 146 at a transfer printing zone. In transport direction A, the recording medium 114 driven by the transport rollers 116 by friction then passes through a fixing station 118 for fixing the two toner images and is subsequently cooled in a cooling device 120.

Figure 3A:
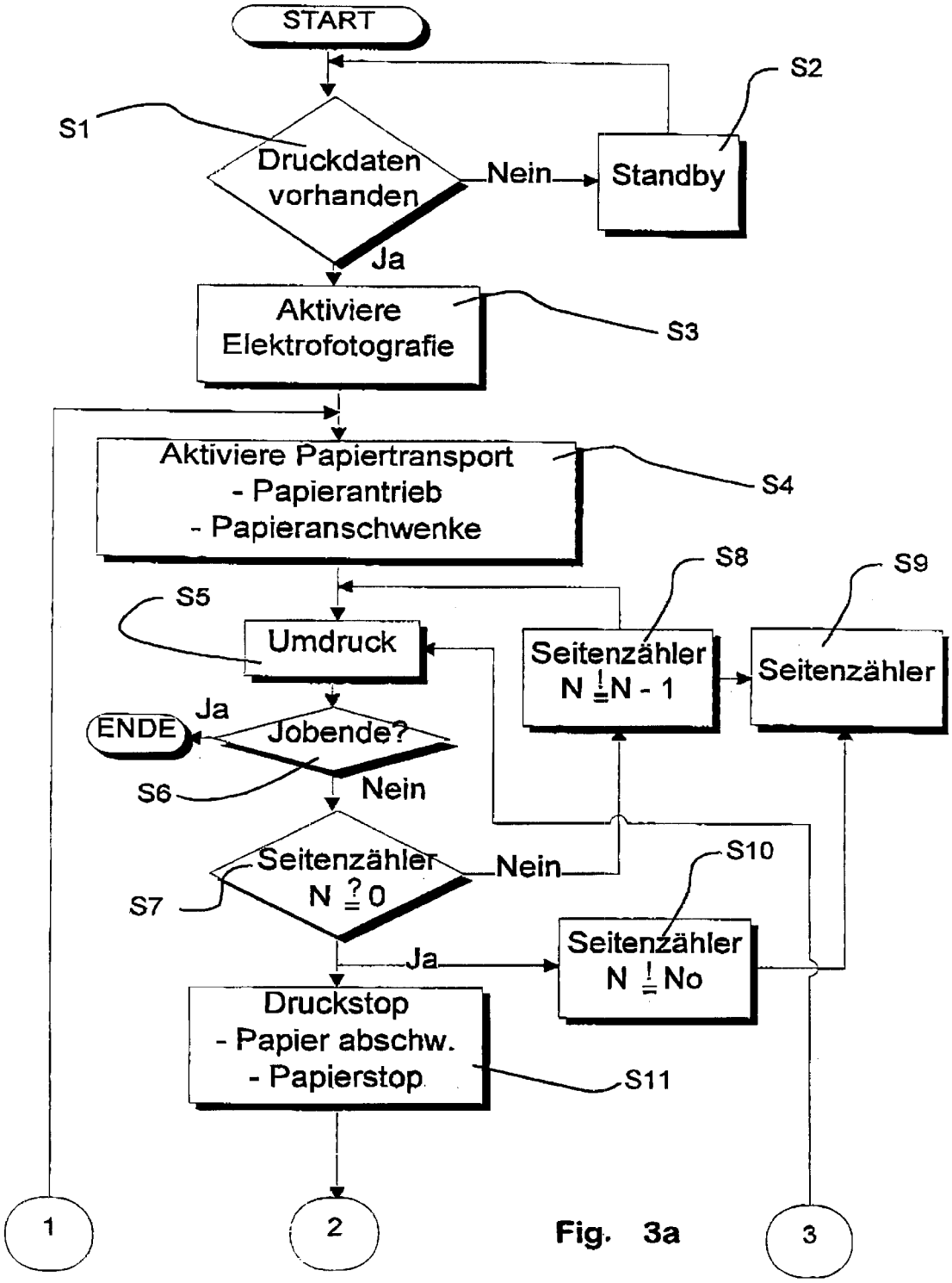
FIGS. 3*a* and 3*b* illustrate a flowchart for printing and generating a toner mark.
Figure 3B:
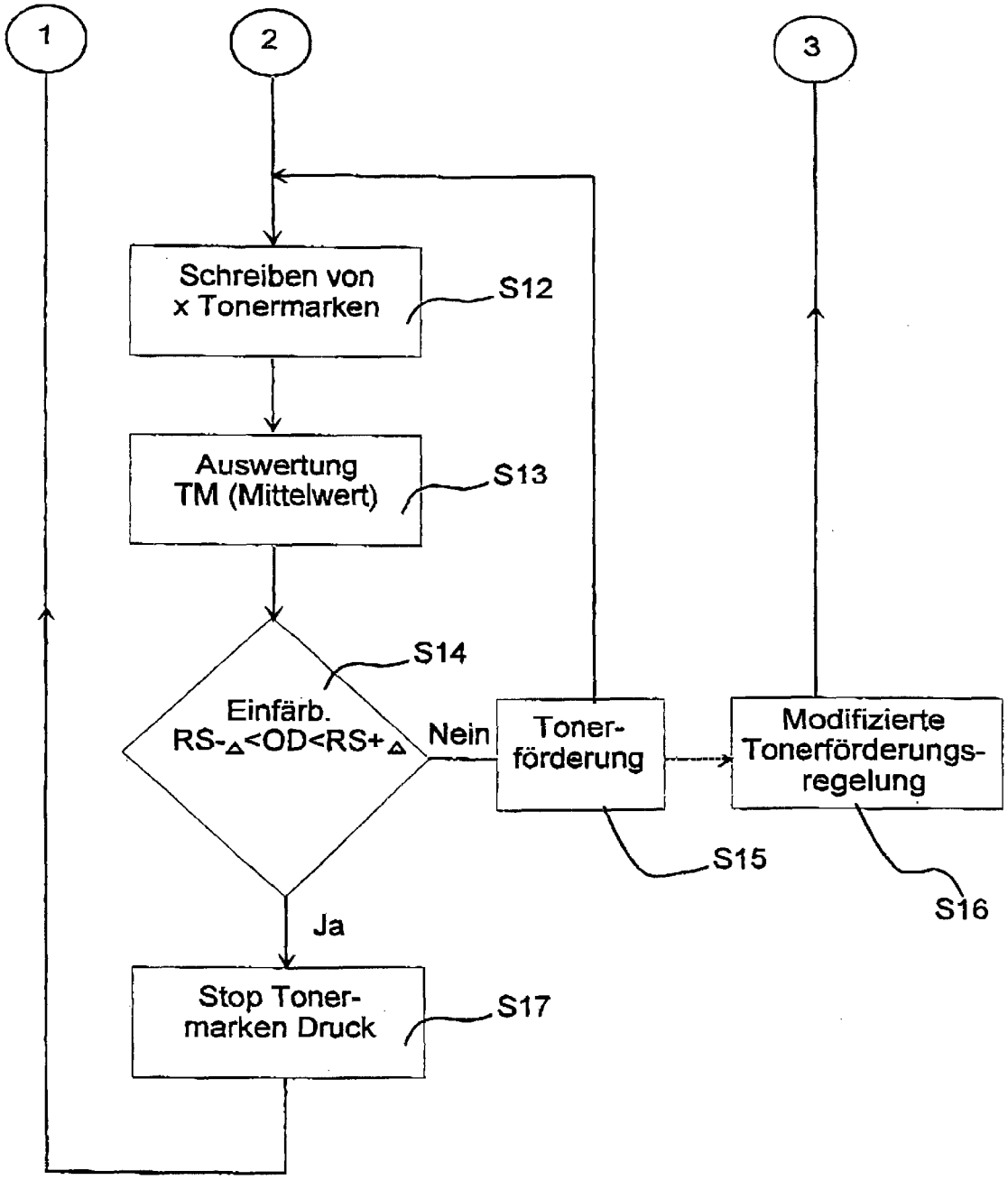

Given this device, too, an operating state corresponding to the exemplary embodiments described in FIGS. 1 through 3 is implemented with the present invention wherein the character generators 124 or, respectively, 138 and at least of the development stations 126*a* through 126*e* or, respectively, 140*a* through 140*e* generate a toner mark on at least one photoconductor band 122, 136. The toner mark is then transfer-printed onto one of the transfer bands 130, 144, is sensed on the latter by one of the optoelectronic sensors 154, 156 and is removed from the transfer band without being transfer-printed onto the paper web 114. For that purpose, the two transfer bands 130 and 144 are lifted off from the paper web 114 in the region of the transfer printing stations at the transfer printing zone, so that the transfer printing onto the paper 114 can be prevented.

Alternatively to the sensing of the toner mark on the transfer bands 130, 144, the toner mark on the photoconductor bands 122, 136 can also be sensed by corresponding sensors. Either the transfer printing onto the surfaces 130*a*, 144*a* of the transfer band 130, 144 or the transfer printing onto the paper web 114 is then prevented. For lifting the transfer bands 130, 144 off from the paper web 114 and/or the transfer bands 130, 144 off from the photoconductor bands 122, 136, correspondingly fast switch units are provided in the region of the transfer printing zones 132, 146 and/or 128, 142.

Although the invention was described in such a way that approximately 2000 printed pages of the second operating state lie between two evaluation cycles for the toner mark (i.e. between the automatic start of the first operating state), this plurality of printed pages can be varied dependent on the given stability of the toner concentration regulation, i.e. can be raised or lowered. In the second operating state, the inking is particularly defined only by the toner concentration regulation, whereby at least one of its regulating variables, for example the regulation threshold of the toner concentration, are determined by the first operating state, namely the generation of the toner mark. This version of the invention is therefore also to be considered a toner mark-guided toner concentration regulation.

Instead of being employed in a printer device for web-shaped recording media, the invention can also be employed in a device for single sheets. Preventing the transfer printing in the operating condition wherein a toner mark is formed and interpreted can thereby occur, for example, in such a way that the feed of a sheet-shaped recording medium to the transfer printing station is completely suppressed.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

List of reference characters

1 printer device
2 recording medium (paper web)
3 drive unit
4 photoconductor drum
4*a* surface of the photoconductor drum
5 transfer printing zone
6 character generator
7 charge sensor
8 development station
9 toner reservoir
11 mixing chamber
12 development drum
13 development gap
14 toner mark sensor
15 pressure element
16 cleaning device
17 stripper element
18 corona device
19 drive roller
20 in-swivel actuator motor
21 toner concentration sensor
25 device control
26 controller
27 character generator control
28 electrophotography control
29 electronic of the toner mark sensor
30 control of the d-station
31 electronics of 21
32 electronics of 3
33 electronics of the motor
34 electronics of the actuators
35 electronics for toner transport
114 paper web
116 drive roller
118 fixing station
120 cooling device
122 first photoconductor tape
124 first character generator
126*a–e* development stations
128 first transfer printing location
130 first transfer tape
130*a* surface of the first transfer tape
132 second transfer printing location
136 second photoconductor tape
138 second character generator
140*a–e* development stations
142 third transfer printing location
144 second transfer tape
144*a* surface of the second transfer tape
146 fourth transfer printing location
150 first printing unit
152 second printing unit
A,$A_1$ paper transport direction
B motion direction of the first photoconductor tape
$B_1$ rotational sense of the photoconductor drum
C motion direction of the first transfer tape
D motion direction of the second photoconductor tape
C [sic] motion direction of the second transfer tape

What is claimed is:

1. A method for regulating an electrographic printing or copying process, comprising the steps of:

providing an electrographic intermediate image carrier for receiving an intermediate toner image and wherein the intermediate toner image is later transferred onto a web-shaped recording medium in a shape of a web from a transfer printing surface at a transfer printing zone;

generating a toner mark on the electrographic intermediate image carrier, sensing the toner mark to determine a measured density value based on the toner mark, and then removing the toner mark, a transfer of the toner mark onto the recording medium being prevented in a time span between the generation and the removal of the toner mark;

regulating toner concentration at a development station with the measured density value; and generating information as said intermediate toner image on the electrographic intermediate image carrier and transferring the intermediate toner image onto the recording medium at the transfer printing zone from the transfer printing surface.

2. The method according to claim 1 wherein the toner mark is generated on the intermediate image carrier in a region wherein the information to be printed onto the recording medium are also output.

3. The method according to claim 1 wherein a photoconductor drum as the intermediate image carrier is employed and a surface of the photoconductor drum is employed as said transfer printing surface at the transfer printing zone.

4. A method for regulating an electrographic printing or copying process, comprising the steps of:

providing an electrographic intermediate image carrier for receiving an intermediate toner image and wherein the intermediate toner image is later transferred onto a recording medium from a transfer printing surface at a transfer printing zone;

generating a toner mark on the electrographic intermediate image carrier, sensing the toner mark to determine a measured density value based on the toner mark, and then removing the toner mark, a transfer of the toner mark onto the recording medium being prevented in a time span between the generation and the removal of the toner mark;

regulating toner concentration at a development station with the measured density value;

generating information as said intermediate toner image on the electrographic intermediate image carrier and transferring the intermediate toner image onto the recording medium at the transfer printing zone from the transfer printing surface; and the prevention of toner mark transfer occurring by separating the recording medium from the transfer printing surface at the transfer printing zone.

5. A method for regulating an electrographic printing or copying process, comprising the steps of:

providing an electrographic intermediate image carrier for receiving an intermediate toner image and wherein the intermediate toner image is later transferred onto a recording medium from a transfer printing surface at a transfer printing zone;

generating a toner mark on the electrographic intermediate image carrier, sensing the toner mark to determine a measured density value based on the toner mark, and then removing the toner mark, a transfer of the toner mark onto the recording medium being prevented in a time span between the generation and the removal of the toner mark;

regulating toner concentration at a development station with the measured density value;

generating information as said intermediate toner image on the electrographic intermediate image carrier and transferring the intermediate toner image onto the recording medium at the transfer printing zone from the transfer printing surface; and the prevention of the toner mark transfer during the time span being affected by the toner mark being isolated from the transfer printing zone.

6. A method for regulating an electrographic printing or copying process, comprising the steps of:

providing an electrographic intermediate image carrier for receiving an intermediate toner image and wherein the intermediate toner image is later transferred onto a recording medium from a transfer printing surface at a transfer printing zone;

generating a toner mark on the electrographic intermediate image carrier, sensing the toner mark to determine a measured density value based on the toner mark, and then removing the toner mark, a transfer of the toner mark onto the recording medium being prevented in a time span between the generation and the removal of the toner mark;

regulating toner concentration at a development station with the measured density value;

generating information as said intermediate toner image on the electrographic intermediate image carrier and transferring the intermediate toner image onto the recording medium at the transfer printing zone from the transfer printing surface; and the recording medium being web-shaped and comprising paper.

7. A method for regulating an electrographic printing or copying process, comprising the steps of:

providing an electrographic intermediate image carrier for receiving an intermediate toner image and wherein the intermediate toner image is later transferred onto a recording medium from a transfer printing surface at a transfer printing zone;

generating a toner mark on the electrographic intermediate image carrier, sensing the toner mark to determine a measured density value based on the toner mark, and then removing the toner mark, a transfer of the toner mark onto the recording medium being prevented in a time span between the generation and the removal of the toner mark;

regulating toner concentration at a development station with the measured density value;

generating information as said intermediate toner image on the electrographic intermediate image carrier and transferring the intermediate toner image onto the recording medium at the transfer printing zone from the transfer printing surface;

a photoconductor drum as the intermediate image carrier and employing a surface of the photoconductor drum as said transfer printing surface at the transfer printing zone; and the recording medium being lifted off from the transfer printing surface of the photoconductor drum for one revolution thereof.

8. A method for regulating an electrographic printing or copying process, comprising the steps of:

providing an electrographic intermediate image carrier for receiving an intermediate toner image and wherein the intermediate toner image is later transferred onto a recording medium from a transfer printing surface at a transfer printing zone;

generating a toner mark on the electrographic intermediate image carrier, sensing the toner mark to determine a measured density value based on the toner mark, and then removing the toner mark, a transfer of the toner mark onto the recording medium being prevented in a time span between the generation and the removal of the toner mark;

regulating toner concentration at a development station with the measured density value;

generating information as said intermediate toner image on the electrographic intermediate image carrier and transferring the intermediate toner image onto the recording medium at the transfer printing zone from the transfer printing surface; and employing a photoconductor band as a first intermediate image carrier, and employing a transfer band as a second intermediate image carrier, the information to be printed being generated on the first intermediate image carrier and subsequently transferred onto the transfer band, and employing a surface of the transfer band as said transfer printing surface at said transfer printing zone.

9. The method according to claim 8 wherein the sensing of the toner mark occurs on the transfer band.

10. A method for operation of an electrographic printer or copier device having an intermediate image carrier on which an intermediate image is generated corresponding to information to be printed on a recording medium by a transfer printing surface at a transfer printing zone, and having a development station, comprising the steps of:

generating in a first operating state a toner mark on the intermediate image carrier, subsequently sensing a density of the toner mark to provide a density value, and then removing the toner mark from the intermediate image carrier, the sensed toner density value being employed for regulation of toner concentration in the development station;

generating in a second operating state information on the intermediate image carrier and transfer printing the information onto the recording medium later; and at least temporarily separating the recording medium from the transfer printing surface in the first operating state.

11. The method according to claim 10 wherein a switch into the first operating state is made after a predetermined number of printed pages of the second operating state.

12. The method according to claim 11 wherein sensed density values of a number of toner marks between which device operating phases of the second operating state lay are employed in common for the regulation of the toner concentration in the development station.

13. The method according to claim 10 wherein the sensed density value of the toner mark is employed for regulating toner delivery in the development station of the device.

14. The method according to claim 10 wherein the toner concentration in the development station is regulated in the second operating state in that at least one of a rated toner concentration value and a regulation threshold is formed from the toner density value determined in the preceding first operating state, and the toner concentration in the development station is identified with a toner concentration sensor.

15. An electrographic printer or copier device, comprising:

an intermediate image carrier on which an intermediate image is generated corresponding to information to be printed onto a web-shaped recording medium shaped as a web;

a control for producing a first operating state wherein a toner mark is generated on the intermediate image carrier, the toner mark being subsequently sensed and then in turn removed from the intermediate image carrier, and for producing a second operating state wherein information are generated on the intermediate image carrier as a toner image and are transfer-printed onto the recording medium, the transfer printing of information onto the recording medium being at least temporarily prevented in the first operating state; and a transfer printing prevention unit for preventing the transfer printing in the first operating state.

16. An electrographic printer or copier device, comprising:

an intermediate image carrier on which an intermediate image is generated corresponding to information to be printed onto a recording medium;

a control for producing a first operating state wherein a toner mark is generated on the intermediate image carrier, the toner mark being subsequently sensed and then in turn removed from the intermediate image carrier, and for producing a second operating state wherein information are generated on the intermediate image carrier as a toner image and are transfer-printed onto the recording medium, the transfer printing of information onto the recording medium being at least temporarily prevented in the first operating state;

a transfer printing prevention unit for preventing the transfer printing in the first operating state; and the transfer printing prevention unit lifts the recording medium off from the surface of the intermediate image carrier.

17. A method for regulating an electrographic image transfer process, comprising the steps of:

providing a photoconductor intermediate image carrier for receiving an intermediate toner image and wherein the intermediate toner image is later transferred onto a web-shaped recording medium shaped as a web from a transfer printing surface at a transfer printing zone;

generating a toner mark on the photoconductor intermediate image carrier, sensing the toner mark, and then removing the toner mark, a transfer of the toner mark onto the recording medium being prevented in a time span between the generation and the removal of the toner mark;

regulating toner concentration at a development station based on the sensed toner mark; and generating information as said intermediate toner image on the photoconductor intermediate image carrier and transferring the intermediate toner image onto the recording medium at the transfer printing zone from the transfer printing surface.

18. A method for operation of a photoconductor image transfer device having an intermediate image carrier on which an intermediate image is generated corresponding to information to be printed on a recording medium by a transfer printing surface at a transfer printing zone, and having a development station, comprising the steps of:

generating in a first operating state a toner mark on the intermediate image carrier, subsequently sensing the toner mark, and then removing the toner mark from the intermediate image carrier, the sensed toner mark being employed for regulation of toner concentration in the development station;

generating in a second operating state information on the intermediate image carrier and transfer printing the information onto the recording medium; and at least temporarily separating the recording medium from the transfer printing surface in the first operating state.

19. A photoconductor image transfer device, comprising:

an intermediate image carrier on which an intermediate image is generated corresponding to information to be printed onto a web-shaped recording medium in a shape of a web by a transfer printing surface of a transfer printing zone;

a control for producing a first operating state wherein a toner mark is generated on the intermediate image carrier, the toner mark being subsequently sensed and then in turn removed from the intermediate image carrier, and for producing a second operating state wherein information are generated on the intermediate image carrier as a toner image and are transfer-printed onto the recording medium, the transfer printing of information onto the recording medium being at least temporarily prevented in the first operating state; and a transfer printing prevention unit for preventing transfer printing in the first operating state by a transfer printing surface being moved away from the recording medium in the transfer printing zone.

* * * * *